US006302622B1

(12) United States Patent
Nagasawa

(10) Patent No.: US 6,302,622 B1
(45) Date of Patent: Oct. 16, 2001

(54) TAMPING RAMMER

(75) Inventor: Kenichi Nagasawa, Saitama-ken (JP)

(73) Assignee: Mikasa Sangyo Co., Ltd., Tokyo (JP)

( * ) Notice: Subject to any disclaimer, the term of this patent is extended or adjusted under 35 U.S.C. 154(b) by 0 days.

(21) Appl. No.: 09/533,053

(22) Filed: Mar. 22, 2000

(30) Foreign Application Priority Data

Mar. 26, 1999 (JP) ..... 11-084072

(51) Int. Cl.[7] ..... E01C 19/35

(52) U.S. Cl. ..... 405/133.1; 405/133.05; 405/102

(58) Field of Search ..... 404/102, 118, 404/133.05, 133.1; 173/118

(56) References Cited

U.S. PATENT DOCUMENTS

| | | | | |
|---|---|---|---|---|
| 3,090,286 | * | 5/1963 | Kestel | 404/133.1 |
| 3,109,354 | * | 11/1963 | Van Kirk | 404/133.1 |
| 3,270,635 | * | 9/1966 | Kestel | 404/133.1 |
| 3,277,801 | * | 10/1966 | Horvath et al. | 404/133.1 |
| 3,308,728 | * | 3/1967 | Brown | 404/133.1 |
| 3,308,729 | * | 3/1967 | Kestel | 404/133.1 |
| 3,416,418 | * | 12/1968 | Forhnauer, Jr. | 404/133.1 |
| 3,492,924 | * | 2/1970 | Fors et al. | 404/133.1 |
| 3,538,821 | * | 11/1970 | Baeumers et al. | 404/133.1 |
| 3,603,225 | * | 9/1971 | Buck | 404/133.1 |
| 3,636,834 | * | 1/1972 | Waschulewski et al. | 404/133.1 |
| 3,673,931 | * | 7/1972 | Dening et al. | 404/133.1 |
| 3,756,735 | * | 9/1973 | Linz | 404/133.05 |
| 3,759,624 | * | 9/1973 | Hundey et al. | 404/133.1 |
| 3,832,081 | * | 8/1974 | Opderbeck et al. | 404/133.1 |
| 3,847,498 | * | 11/1974 | Grane et al. | 404/133.1 |
| 4,014,620 | * | 3/1977 | Vural et al. | 404/133.1 |
| 4,015,909 | * | 4/1977 | Yamamoto | 404/133.1 |
| 4,104,001 | * | 8/1978 | Uebel | 404/133.1 |
| 4,170,427 | * | 10/1979 | Grane | 404/133.1 |
| 4,186,197 | * | 1/1980 | Tetsuo | 404/133.1 |
| 5,261,762 | * | 11/1993 | Yamaguchi | 404/133.05 |
| 5,645,370 | * | 7/1997 | Zuerbes et al. | 404/133.1 |
| 6,000,879 | * | 12/1999 | Greppmair | 404/133.1 |

FOREIGN PATENT DOCUMENTS

| | | | | |
|---|---|---|---|---|
| 3439534-A1 | * | 5/1986 | (DE) | E02D/3/46 |
| 58-165005 | | 11/1983 | (JP) . | |
| 62-196209 | | 12/1987 | (JP) . | |
| 1-84307 | | 6/1989 | (JP) . | |
| 401214607-A | * | 8/1989 | (JP) | E01C/19/35 |
| 401247605-A | * | 10/1989 | (JP) | E01C/19/38 |
| 401247606-A | * | 10/1989 | (JP) | E01C/19/38 |

* cited by examiner

*Primary Examiner*—Thomas B. Will
*Assistant Examiner*—Alexandra K. Pechhold
(74) *Attorney, Agent, or Firm*—Frishauf, Holtz, Goodman, Langer & Chick, P.C.

(57) ABSTRACT

A tamping rammer capable of optimum tamping of the ground by its stable jumping behavior when tamping hard ground without giving rise to unstable jumping of the machine, includes a tamping foot having a tamping plate which has an area for supporting the machine body at the bottom of the tamping plate which contacts the ground parallel thereto. The support area comprises a flat range R around a perpendicular line B drawn from the center of gravity G of the machine to the ground. The range R has a radius r corresponding to the distance between the line B and the centerline A of the machine drawn to the ground along the longitudinal direction of the tamping foot.

14 Claims, 5 Drawing Sheets

TAMPING RAMMER

BACKGROUND OF THE INVENTION AND RELATED ART STATEMENT

This invention concerns improvements made to tamping rammers for tamping the ground, and mile particularly to the structure of a tamping plate of a tamping rammer.

A conventional tamping rammer shown in FIG. 6 comprises a tamping foot 32 comprising an inner spring cylinder 34 and an outer guide cylinder 33 which are inserted slidably to each other below a power transmission system 31 which changes rotational movements of an engine 30 to vertical movements, and a tamping plate 35 at the lower end of the tamping foot 32. As vertical movements of the transmission system 31 are transmitted to a coil spring 37 positioned inside the spring cylinder 34 via a piston rod 36, the vertical movements of the spring cylinder 34 generated by compression of the coil spring 37 are transmitted to the tamping plate 35. This structure is widely known, for instance, from Japanese UM Kokai Heil-84307.

The above mentioned rammer generally requires a coil spring 37 with a large spring constant in order to efficiently perform tamping of the ground C with a strong impact force by increasing the amount of jumping of the tamping plate 35.

In this type of rammer, the centerline A of the machine body along the longitudinal direction of the guide cylinder 33 and the spring cylinder 34 comprising the tamping foot 32 is tilted frontward in respect of the bottom face of the tamping plate 35 contacting the ground so that the machine automatically advances repeating jumps of the tamping plate 35. Generally, there is provided a sleigh-shaped component with the front end or the front and rear ends standing upright from the bottom face of the tamping plate 35 for securely supporting the machine body, and the entire bottom face contacting the ground is flat and parallel to the ground.

In some rammers, the bottom face of the tamping plate is shaped like a hill when looked from the side as disclosed in Japanese UM Kokai Sho62-196209, or has a spherical surface as disclosed in Japanese UM Kokai Sho58-165005.

On the other hand, a conventional rammer, of which tamping plate 35 has a flat ground-contacting face at the bottom which is entirely parallel to the ground as shown in FIG. 6, is used for tamping the soft ground or the relatively hard ground paved with asphalt depending on the purpose of work. In this case, increasing the amount of jumping of the tamping plate 35 by the coil spring 37 with a large spring constant as discussed above achieves effective tamping and presents no problems even if the ground is soft.

However, it the rammer provided with a coil spring having a large spring constant is used to tamp the relatively hard ground surface paved with asphalt, etc., impact resilience between the ground and the tamping plate 35 becomes high, making jumping behavior of the rammer unstable and causing it "to dance", creating problems for the operator.

The rammer on such an occasion jumps swaying lengthwise and crosswise, and the tamping plate cannot carry out strokes parallel to the ground.

The inventor of this invention studied causes for such unstable jumping behavior when a conventional rammer is used for tamping the hard ground, and found out that the tamping plate of a conventional rammer has a bottom face that is completely parallel to the ground except for a tilted surface standing upright at the front end of the plate.

As shown in FIG. 6, the centerline A of the tamping foot 32 of the rammer is tilted forward in respect of the ground-contacting face of the tamping plate 35 in order that the machine automatically advances while repeating jumps. Thus, the machine jumps in the direction along the centerline A.

On the other hand, the center of gravity G of the machine is positioned at the rear of the centerline A at the middle of the machine height so that the machine is stably supported instead of falling forward when the bottom face of the tamping plate 35 contacts the ground C. However, as the tamping foot 32 is tilted forward as mentioned above, the point E on the bottom face of the tamping plate 35 that receives the perpendicular line B from the center of gravity G is in the front of the point D on the bottom face of the tamping plate 35 where the centerline A passes.

As shown in FIG. 7, when the rammer jumps to a certain height and then falls, the tamping plate 35 hits the ground C and the center of gravity G moves forward by a large margin beyond the point D on the bottom face of the tamping plate 35 where the centerline A passes. The tamping foot 32 assumes a frontward tilting posture so that the angle θ2 between the centerline A and the ground C becomes larger than the angle θ1 shown in FIG. 6.

As the center of gravity G leans forward beyond the point D where the centerline A passes at the moment when the tamping plate 35 hits the ground C, the centerline A assumes the frontward tilting posture with the angle θ2. Since the bottom face of the tamping plate 35 is entirely flat, it momentarily becomes unstable with its rear end floating up and creating a void between the ground C and the point M, which is ahead of the point E supporting the center of gravity G.

When the machine jumps and the tamping plate 35 rises at the next moment, the machine is unstably supported at the point M, which is in front of the point E receiving the center of gravity G. As shown in FIG. 8, the machine then jumps bending backward (to the right) and the tilting angle θ3 of the centerline A becomes smaller than the original angle θ1 shown in FIG. 6, causing the tamping plate 35 to hit the ground from the point N at its rear end, thus creating unstable conditions again.

Movements mentioned above were described in respect of the lengthwise direction of the machine. In practice, such movements occur also in respect of crosswise direction because of a similar reason or because of the irregular ground surface. Thus, tamping the hard ground with a rammer creates extremely unstable jumping behavior of the machine, forcing the operator to work with extreme difficulty.

In order to prevent unstable jumping behavior of the machine when tamping the hard ground, the stroke length of the tamping plate may be shortened or the spring constant of the coil spring may be minimized. However, such measures are not enough to achieve sufficient and effective tamping effects even though the work may be performed perfunctorily.

SUMMARY OF THE INVENTION

The present invention aims to obviate the above mentioned problems of conventional tamping rammers and to offer a tamping rammer which can perform adequate tamping of the ground at all times with stable jumping behavior without deteriorating the tamping performance even when tamping the hard ground.

According to this invention, in a rammer of which body is tilted forward in respect of the tamping plate, there are provided on the bottom face of the tamping plate contacting the ground parallel thereto a flat area for validly supporting the machine body having the range R and the radius r corresponding to the distance between the perpendicular line B drawn from the center of gravity G of the machine body to the ground and the centerline A of the machine body drawn in inclined fashion along the longitudinal direction of the tamping foot, and inclined surfaces around the supporting area standing upright toward the outer edge of the tamping plate on the outer periphery of the free-supporting area of the machine.

According to a preferred embodiment of the present invention, the area for validly supporting the machine body is provided on the bottom face of the tamping plate and has a circular range R having the radius r that corresponds to the distance between the perpendicular line B drawn from the machine center of gravity G to the ground and the centerline A inclining toward the ground along the longitudinal direction of the tamping foot.

According to another preferred embodiment of the present invention, the area for validly supporting the machine body is provided on the bottom face of the tamping plate and has a rectangular range R having the radius r that corresponds to the distance between the perpendicular line B drawn from the center of gravity G and the centerline A inclining toward the ground along the longitudinal direction of the tamping foot.

According to yet another preferred embodiment of the present invention, there are provided inclined surfaces standing toward the outer edge of the tamping plate from the area supporting the machine on the outer periphery around the supporting area in the tamping plate.

Still another embodiment of the present invention discloses convex curved surfaces standing toward the outer edge of the tamping plate from the area validly supporting the machine on the outer periphery of the area of the machine in the tamping plate.

Yet another embodiment of the present invention discloses a flat octagonal tamping plate provided with inclined connecting edges at the four corners of the plate.

The rammer of the present invention has a flat area for validly supporting the machine body around the point E of the range R with the radius r corresponding to the distance between the point E on the perpendicular line B drawn from the center of gravity G of the machine toward the ground and the point D where the centerline A passes. The machine body thus stands stably on the ground C without toppling because of this flat area during stationary period as well as during jumping.

When tamping the soft ground with the present invention rammer, movements of the machine to lean forward by the center of gravity G are restrained to be within the area validly supporting the tamping plate so that optimum tamping of the ground can always be secured within the supporting area.

When tamping the hard ground, the tamping plate leans forward as it receives impact resilience from the hard ground C when it hits the ground after jumping upward and moves outside of the supporting area. In such case, the tamping plate leans forward from the border of the supporting area and its outer peripheral inclined surfaces. Therefore, even if the machine receives the upward jumping force at the next moment, it does not bend backward and jumping of the machine body in an unstable posture via the tamping plate can be prevented.

DETAILED DESCRIPTION OF THE PREFERRED EMBODIMENTS

Figure 1:
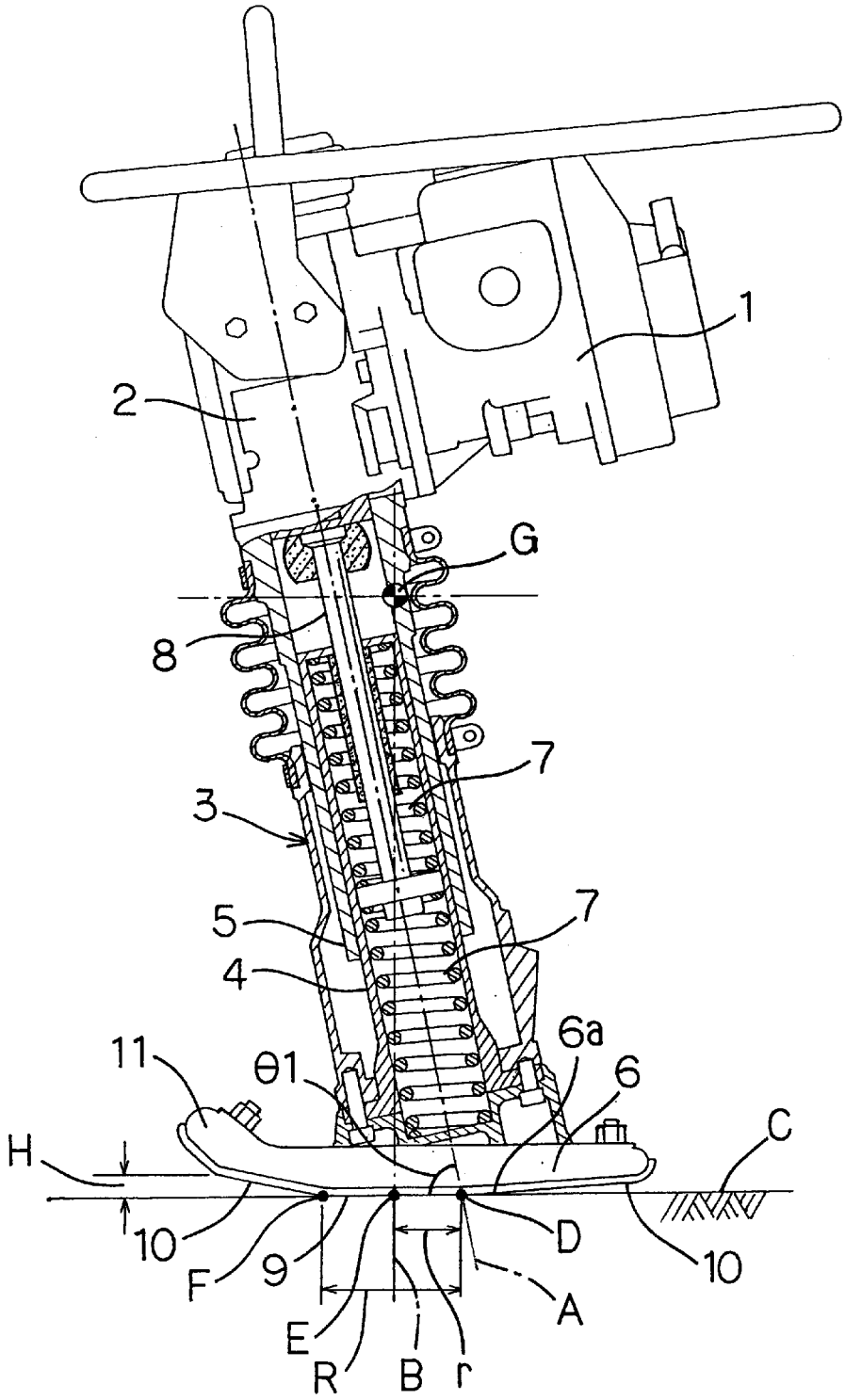
FIG. 1 shows a partial vertical sectional view showing the construction of the rammer of the present invention.

The construction of the rammer of the present invention is explained in respect of the embodiments shown in the drawing. As shown in FIG. 1, the rammer of present invention includes a power transmission mechanism 2 which changes rotational movements of a prime mover 1 to vertical movements, a tamping foot 3 comprising an inner cylinder 4 and an outer cylinder 5 which are inserted into each other in a freely slidable fashion below the mechanism 2, and a tamping plate 6 at the lower end of the tamping foot 3. The vertical movements of the transmission mechanism 2 are transmitted to a coil spring 7 of the inner cylinder 4 via a piston rod 8 and the vertical movements of the inner cylinder 4 generated by the resilience of the coil spring 7 are transmitted to the tamping plate 6.

The tamping foot 3 is inclined forward in respect of the tamping plate 6, and as the vertical movements of the transmission mechanism 2 are transmitted to the coil spring 7 of the inner cylinder 4 via the piston rod 8, the machine body moves reciprocatingly in the vertical direction along the machine centerline A, which is parallel to the longitudinal direction of the cylinders 4 and 5.

The tamping plate 6 provided at the lower end of the tamping foot 3 is made of plywood or synthetic resin, but the bottom face 6*a* of the tamping plate contacting the ground C is made of a metallic plate. The bottom face 6*a* is not entirely flat, but has a flat area 9 for effectively supporting the machine at the substantial center of the face 6*a* in order to stably support the machine body above.

The area 9 has a prescribed range around the point E receiving the center of gravity G on the bottom face 6*a* of the tamping plate on the perpendicular line B drawn from the center of gravity G above the tamping plate 6 to the ground C. More concretely, the range R should preferably have the radius r around the point E, the radius r being equal to the distance between the point E and the point D where the machine centerline A passes.

Figure 2:
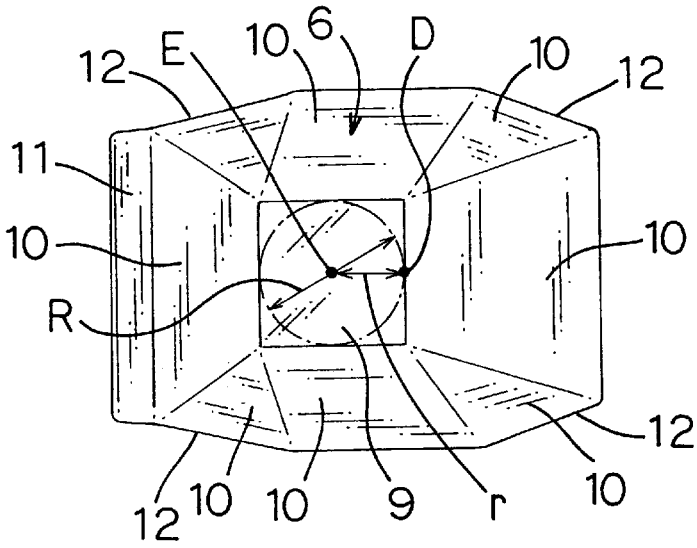
FIG. 2 shows a bottom view showing the shape of a tamping plate of the rammer of the present invention.

As shown in FIG. 2, the range R of the area 9 may be a circle around the point E receiving the center of gravity G and having the radius r between the point E and the point D where the centerline A passes, or the area may be a rectangle or a polygon so long as it contains this circular range R inside.

On the 360-degree outer periphery around the flat area 9 on the bottom face 6*a* of the tamping plate 6 are provided inclined surfaces 10 which are inclined upward with a relatively gradual inclination angle toward the outer edge of the tamping plate 6. As is clear from FIGS. 2 and 3, the bottom face 6*a* of the tamping plate is shaped like a deep dish with its bottom corresponding to the area 9 when looked from above. At the front end of the tamping plate 6 is provided a sleigh-like component 11, and the inclined surfaces 10 in front of the area 9 extend upward so as to cover the bottom face of the sleigh-like component 11.

Figure 3:
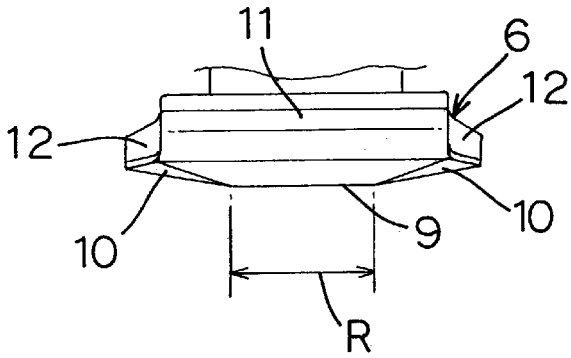
FIG. 3 shows a front view of the tamping plate.
Figure 4:
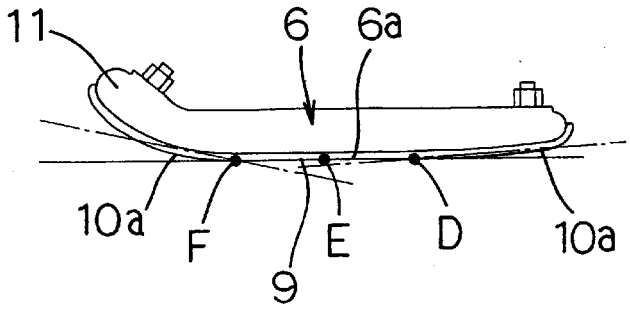
FIG. 4 shows a side view showing the construction of one embodiment of the tamping plate of the present condition.

The inclined surfaces 10 provided on the outer periphery of the area 9 should preferably have the height H of 3 to 5 mm from the highest position as shown in FIG. 1. The inclined surfaces 10 can be a plurality of flat inclined surfaces continuing via folded lines toward the outer edge of the area 9 or the tamping plate 6 as shown in FIGS. 1 and 3. As shown in FIG. 4, they can have convex curved surfaces 10*a* rising toward the outer periphery of the tamping plate 6 from the area 9.

The area 9 and the tamping plate 6 having inclined surfaces 10 on the outer periphery thereof are shaped octagonal when looked from above by respectively being provided with inclined connecting edges 12 on both sides of the front end and the rear end.

The rammer of the present invention has a flat machine supporting area 9 on the bottom face 6*a* of the tamping plate that contacts the ground, and its range R around the point E on the perpendicular line B from the center of gravity of G to the ground C has the radius r corresponding to the distance from the point E to the point D where the centerline A passes. The rammer therefore stands stably on the ground C supported by the area 9 at the time the machine is stationary.

The rammer of the present invention can perform optimum tamping of the soft ground even when the tamping plate 6 is imparted with an intense impact force of a large jump by the coil spring 7 of a large spring constant, because of the range R of the area 9 and the inclined surfaces 10 surrounding the range R. The present invention also prevents the rammer from assuming unstable forward leaning posture by restraining the centerline A to remain inside the range R of the area 9 as the area 9 and the surrounding surfaces 10 contact the ground even when the center of gravity G is applied with a force pushing the tamping plate 6 forward beyond the point D where the centerline A passes because the ground is soft. The area 9 can naturally give optimum forward power by generating the jump of an optimum angle along the centerline A.

Figure 5:
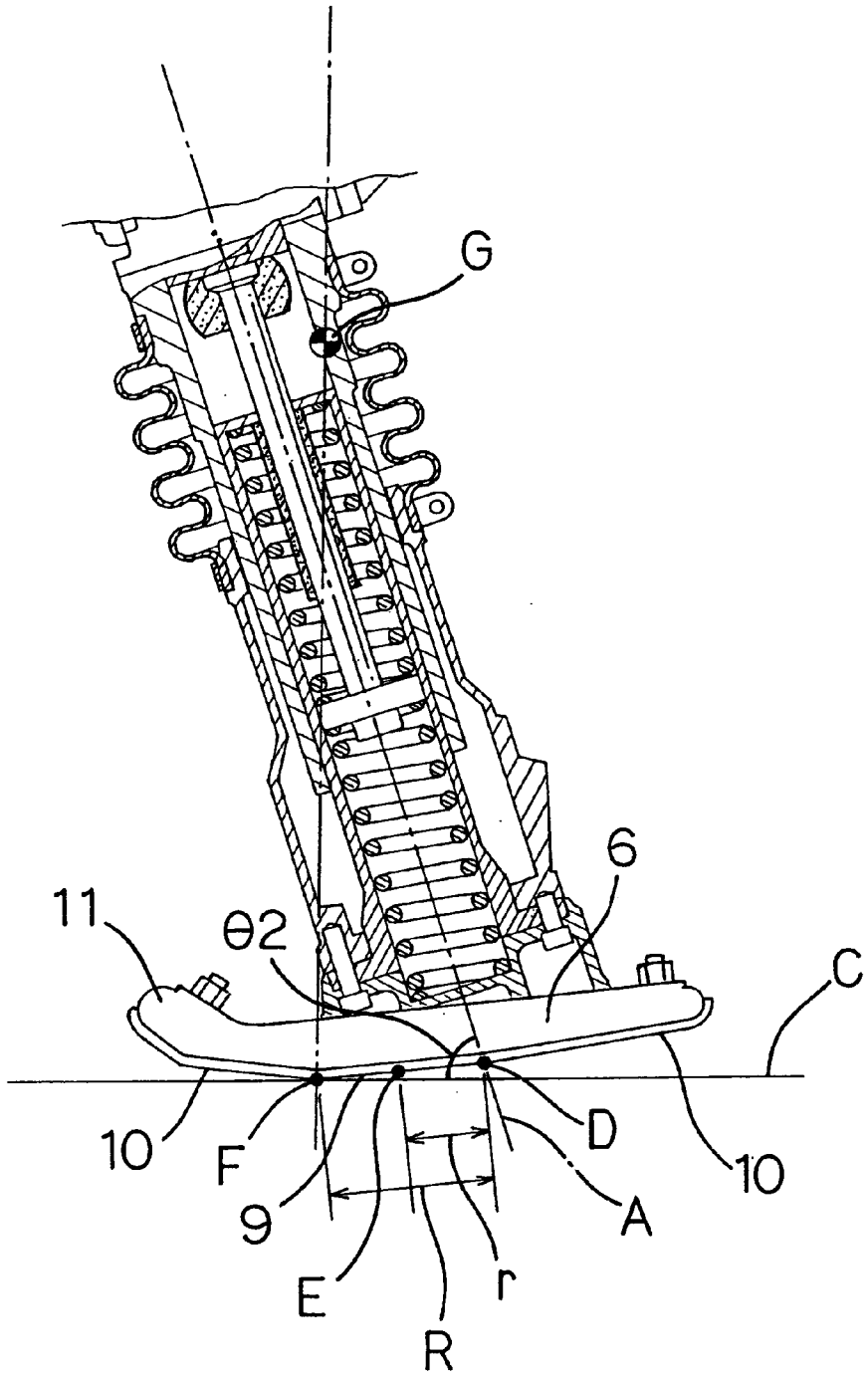
FIG. 5 shows a partial side view of the movement of the rammer of the present invention on hard ground.
Figure 6:
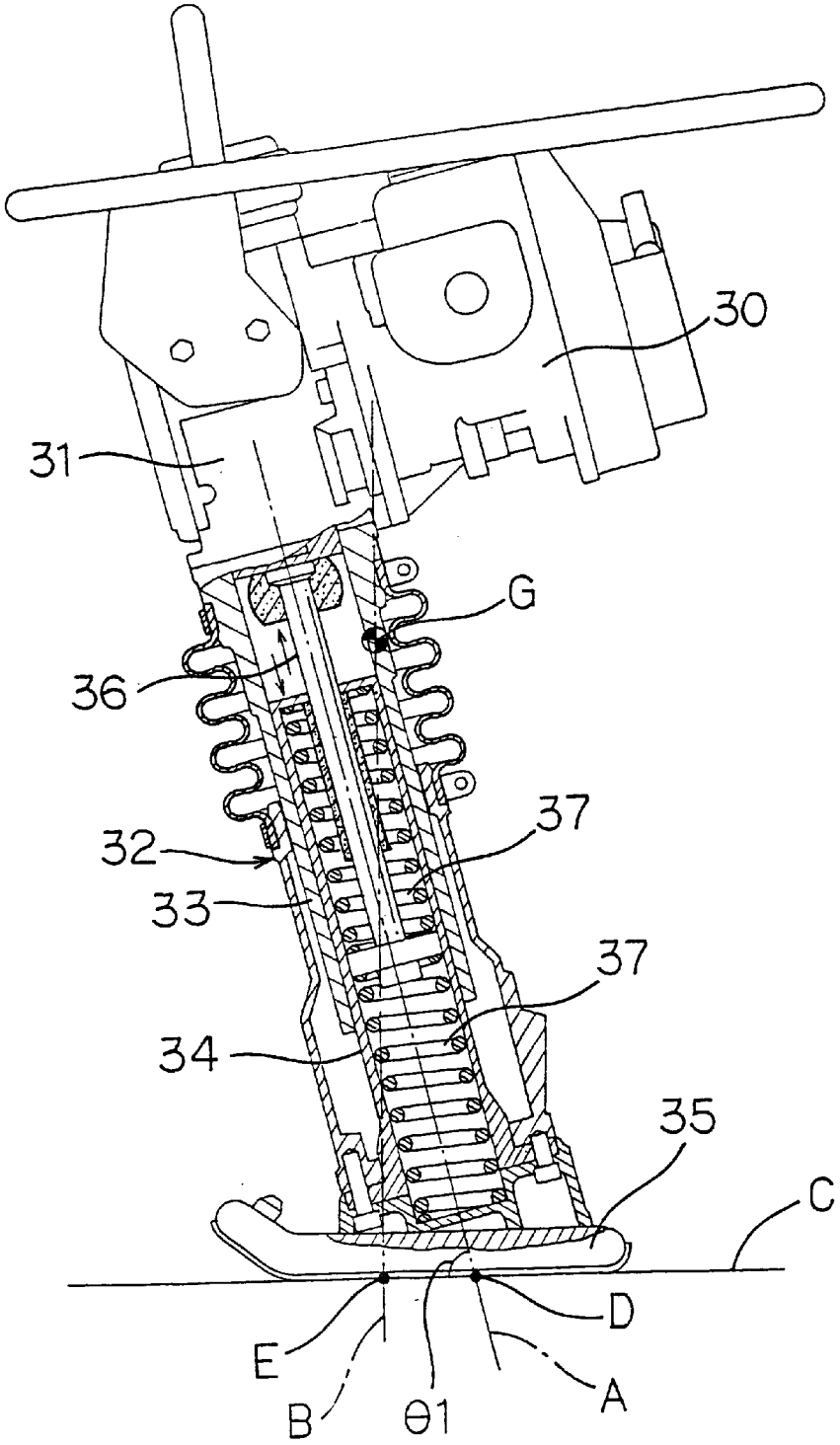
FIG. 6 PRIOR ART
FIG. 6 shows a partial fragmental section showing the structure of a conventional rammer.

On the other hand, when tamping the hard ground with the rammer of the present invention, the machine body jumps upward and then hits the ground as shown in FIG. 5, so that the tamping plate 6 receives the impact resilience from the hard ground C and moves beyond the point D where the centerline A passes on the bottom face 6*a* of the tamping plate, and the machine becomes inclined forward and assumes the inclination angle θ2 which is larger than the angle θ1 of the centerline A of FIG. 1.

In such a case, the tamping plate 6 becomes inclined so that the rear end including the flat area 9 moves away from the ground C, but since the tamping plate 6 is provided with inclined surfaces 10 on the outer periphery of the area 9, the plate becomes inclined at the border point F between the area 9 and the inclined surfaces 10 in front.

Figure 7:
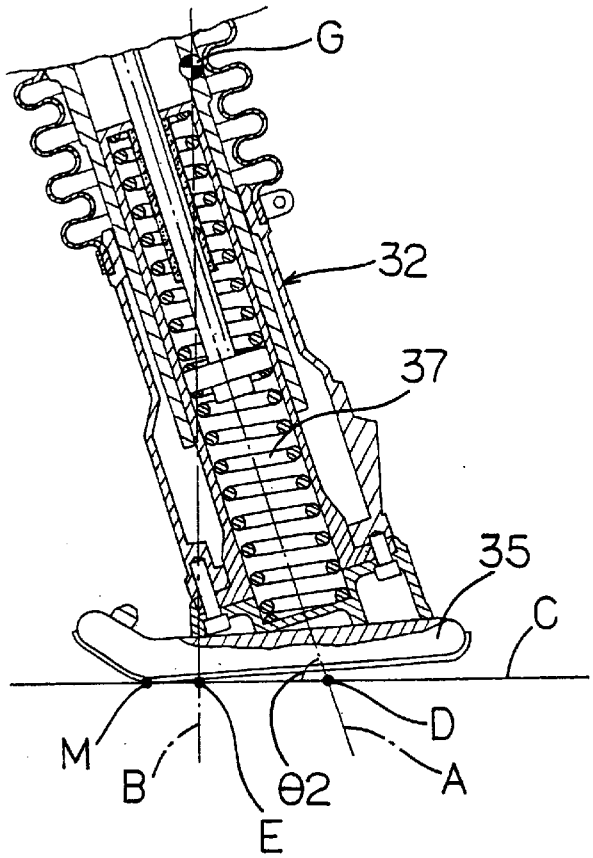
FIG. 7 PRIOR ART
FIG. 7 is a partial side view showing the movement on the hard ground of the rammer shown in FIG. 6.
Figure 8:
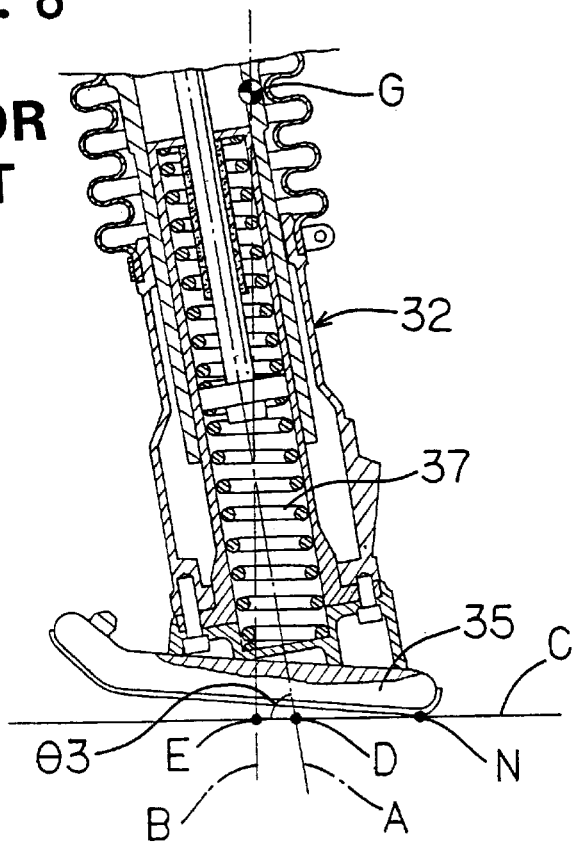
FIG. 8 PRIOR ART
FIG. 8 is a partial side view showing the movement following that shown in FIG. 7 of the rammer of FIG. 6.

This point F, however, belongs to the range R of the area 9 which is nearer to the point D where the centerline A passes compared to the contact point M on the bottom face of the tamping plate generated at the time the completely flat tamping plate 35 is inclined in a similar fashion. Therefore, if the machine body jumps upward from the point F in the next instant, the tamping plate does not bend backward (the right side) as the conventional plate 35 shown in FIG. 7 does, but the point D on the area 9 where the centerline A passes contacts the ground. Since the movement is the same as when the area 9 jumps while contacting the ground C via its flat surface, the machine body is prevented from jumping in unstable conditions.

The above mentioned movement of the tamping plate 6 in respect of the ground C is observed not only when the machine body leans forward as shown in the figure, but also when the perpendicular line B drawn from the center of gravity G to the ground C bends backward or crosswise every time the machine jumps so that jumping of the machine on the hard ground is kept stable always.

By providing connecting edges 12 at the four corners of the outer peripheral edge of the tamping plate 6, the surface becomes an octagon. This is useful to prevent an unstable jump posture by decreasing impacts at unnecessary places when the tamping plate 6 jumps and hits the ground.

As mentioned above, the rammer of the present invention can adequately perform tamping for both soft and hard grounds with a powerful force without shortening the stroke length of the tamping plate even when a coil spring of a large spring constant is used, and can also perform stable jumping for tamping the hard ground, thereby facilitating the tamping operation.

What is claimed is:

1. A tamping rammer provided with a tamping foot, comprising:

a machine body including an inner cylinder and an outer cylinder slidably inserted into each other below a power transmission mechanism to change rotational movements of a prime mover to vertical movements;

a tamping plate at the lower end of the tamping foot; and a coil spring of the inner cylinder receiving the vertical movements of the power transmission mechanism via a piston rod and the coil spring transmitting by its resilience the vertical movements of the inner cylinder to the tamping plate, wherein the tamping plate comprises:

a flat machine body supporting area for supporting the machine body, said flat machine body supporting area comprising a range R having a radius r corresponding to the distance from a perpendicular line B drawn from the center of gravity G of the machine body to the ground and a centerline A of the machine body drawn inclinedly along the longitudinal direction of the tamping foot, and inclined surfaces around said flat area rising toward the outer edge of said tamping plate.

2. The tamping rammer as claimed in claim 1, wherein the flat machine body supporting area provided at the bottom of the tamping plate contacting the ground parallel thereto has a circular range R around the perpendicular line B drawn from the center of gravity G of the machine body to the ground and the radius r corresponding to the distance from the line B and the centerline A of the machine drawn incliningly and the longitudinal direction of the tamping foot to the ground.

3. The tamping rammer as claimed in claim 2, wherein the inclined surfaces are flat inclined surfaces extending from the machine body supporting area on the outer periphery of the tamping plate and which are inclined upwardly toward the outer edge thereof around the machine body supporting area of the tamping plate.

4. The tamping rammer as claimed in claim 2, wherein the inclined surfaces are convex curved inclined surfaces extending from the machine body supporting area on the outer periphery of the tamping plate and which are inclined upwardly toward the outer edge thereof around the machine body supporting area of the tamping plate.

5. The tamping rammer as claimed in claim 2, wherein the tamping plate has an octagonal shape provided with inclined connecting edges at the corners of the tamping plate.

6. The tamping rammer as claimed in claim 1, wherein the flat machine body supporting area provided at the bottom of the tamping plate contacting the ground parallel thereto has a rectangular range R around the perpendicular line B drawn from the center of gravity G of the machine body to the ground and the radius r corresponding to the distance from the line B and the centerline A of the machine drawn inclininglyand the longitudinal direction of the tamping foot to the ground.

7. The tamping rammer as claimed in claim 6, wherein the inclined surfaces are flat inclined surfaces extending from the machine body supporting area on the outer periphery of the tamping plate and which are inclined upwardly toward the outer edge thereof around the machine body supporting area of the tamping plate.

8. The tamping rammer as claimed in claim 6, wherein the inclined surfaces are convex curved inclined surfaces extending from the machine body supporting area on the outer periphery of the tamping plate and which are inclined upwardly toward the outer edge thereof around the machine body supporting area of the tamping plate.

9. The tamping rammer as claimed in claim 6, wherein the tamping plate has an octagonal shape provided with inclined connecting edges at the corners of the tamping plate.

10. The tamping rammer as claimed in claim 1, wherein the inclined surfaces are flat inclined surfaces extending from the machine body supporting area on the outer periphery of the tamping plate and which are inclined upwardly toward the outer edge thereof around the machine body supporting area of the tamping plate.

11. The tamping rammer as claimed in claim 10, wherein the tamping plate has an octagonal shape provided with inclined connecting edges at the corners of the tamping plate.

12. The tamping rammer as claimed in claim 1, wherein the inclined surfaces are convex curved inclined surfaces extending from the machine body supporting area on the outer periphery of the tamping plate and which are inclined upwardly toward the outer edge thereof around the machine body supporting area of the tamping plate.

13. The tamping rammer as claimed in claim 12, wherein the tamping plate has an octagonal shape provided with inclined connecting edges at the corners of the tamping plate.

14. The tamping rammer as claimed in claim 2, wherein the tamping plate has an octagonal shape provided with inclined connecting edges at the corners of the tamping plate.

* * * * *

UNITED STATES PATENT AND TRADEMARK OFFICE

CERTIFICATE OF CORRECTION

PATENT NO. : 6,302,622 B1
DATED : October 16, 2001
INVENTOR(S) : Kenichi Nagasawa It is certified that error appears in the above-identified patent and that said Letters Patent is hereby corrected as shown below:

Column 1,
Line 5, delete “mile” and insert -- more --.

Column 7,
Line 3, delete “claim 2” and insert -- claim 1--.

Signed and Sealed this

Twenty-second Day of July, 2003

JAMES E. ROGAN
*Director of the United States Patent and Trademark Office*